United States Patent [19]

Milberger et al.

[11] 4,407,183

[45] Oct. 4, 1983

[54] METHOD AND APPARATUS FOR HYDRAULICALLY CONTROLLING SUBSEA EQUIPMENT

[75] Inventors: Lionel J. Milberger, Spring; Charles E. Horn; Marvin H. Kluttz, both of Houston, all of Tex.

[73] Assignee: FMC Corporation, Chicago, Ill.

[21] Appl. No.: 53,160

[22] Filed: Jun. 29, 1979

[30] Foreign Application Priority Data

Sep. 27, 1978 [GB] United Kingdom ..... 38283/78

[51] Int. Cl.[3] ..... F01B 25/26

[52] U.S. Cl. ..... 91/1; 91/522; 91/526; 91/527; 137/624.11

[58] Field of Search ..... 137/624.11; 91/526, 91/527, 522, 1

[56] References Cited

U.S. PATENT DOCUMENTS

| | | | |
|---|---|---|---|
| 3,783,899 | 1/1974 | Fowler | 137/624.2 |
| 3,854,380 | 12/1974 | Casey | 91/527 |
| 3,926,217 | 12/1975 | Ohishi | 137/624.11 |
| 3,952,763 | 4/1976 | Baugh | 137/119 |
| 3,993,100 | 11/1976 | Pollard | 137/628 |
| 4,185,541 | 1/1980 | Milberger | 91/526 |

*Primary Examiner*—Abraham Hershkovitz

*Attorney, Agent, or Firm*—L. B. Guernsey; W. W. Ritt, Jr.

[57] ABSTRACT

Method and apparatus for hydraulically controlling subsea well equipment, such as valve operators, connectors, and other hydraulically actuated devices, with a significantly smaller number of hydraulic pressure source lines from the surface to the subsea location of said well equipment and for providing return signals to indicate the state of operation of said well equipment using the same hydraulic lines. The apparatus includes a plurality of hydraulic AND-gate logic elements and a plurality of hydraulic valves mounted near the well equipment. A pair of hydraulic lines between the hydraulic valves and a surface vessel or other surface facility provides control for the various valve operators, connectors and other hydraulically actuated devices, while a third hydraulic line provides power to operate the various devices. The same pair of control lines can be used to transmit signal information from the various devices on the sea floor to the surface vessel to indicate the operating status of these devices.

15 Claims, 9 Drawing Figures

A
B
P
R
AL1
AL2
AL3
AL4
AL5
BL1
BL2
BL3
BL4
BL5
V1
V2
V3
V4
V5
V6
V7
V8
V9
V10
PS1
PS2
PS3
PS4
PS5
PS6
PS7
PS8
PS9
PS10
PR1
PR2
PR3
PR4
PR5
PR6
PR7
PR8
PR9
PR10
A1
A2
A3
A4
A5
P1
P2
P3
P4
P5
P6
P7
P8
P9
P10
B1
B2
B3
B4
B5
S
59
G1
G2
G3
G4
G5
G6
G7
G8
G9
G10
G11
G12
G13
G14
G15
G16
G17
G18
G19
G20
G21
G22
G23
G24
G25
R1
R2
R3
R4
R5
R6
R7
R8
R9
R10
R11
R12
R13
R14
R15
R16
R17
R18
R19
R20
R21
R22
R23
R24
R25
01
02
03
04
05
06
07
08
09
010
011
012
013
014
015
016
017
018
019
020
021
022
023
024
025
50
500
700
1000
1200
1500
1700
2000
2200
2500
2700

FIG_3
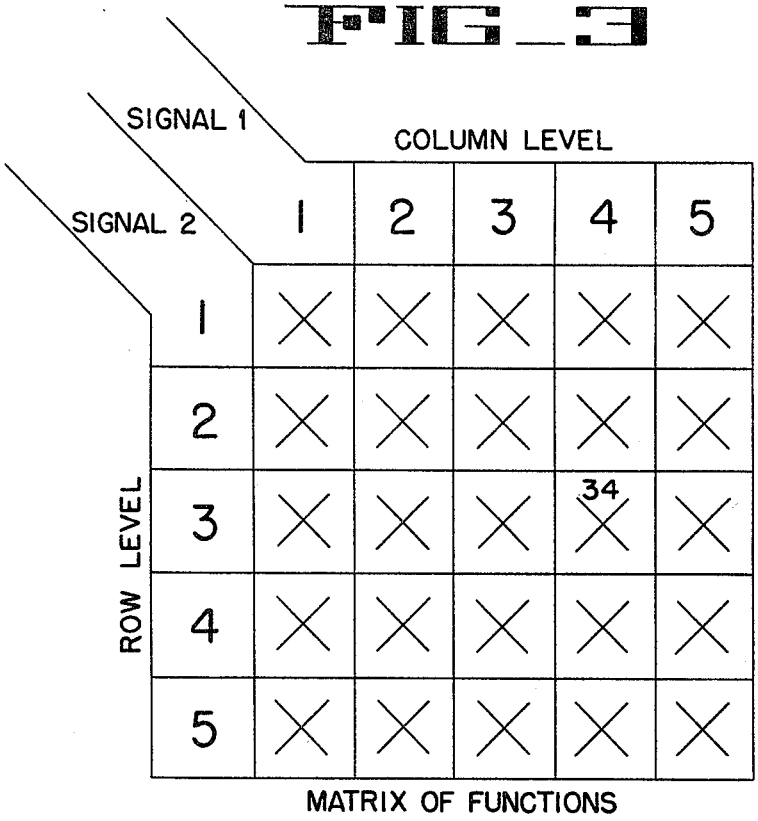
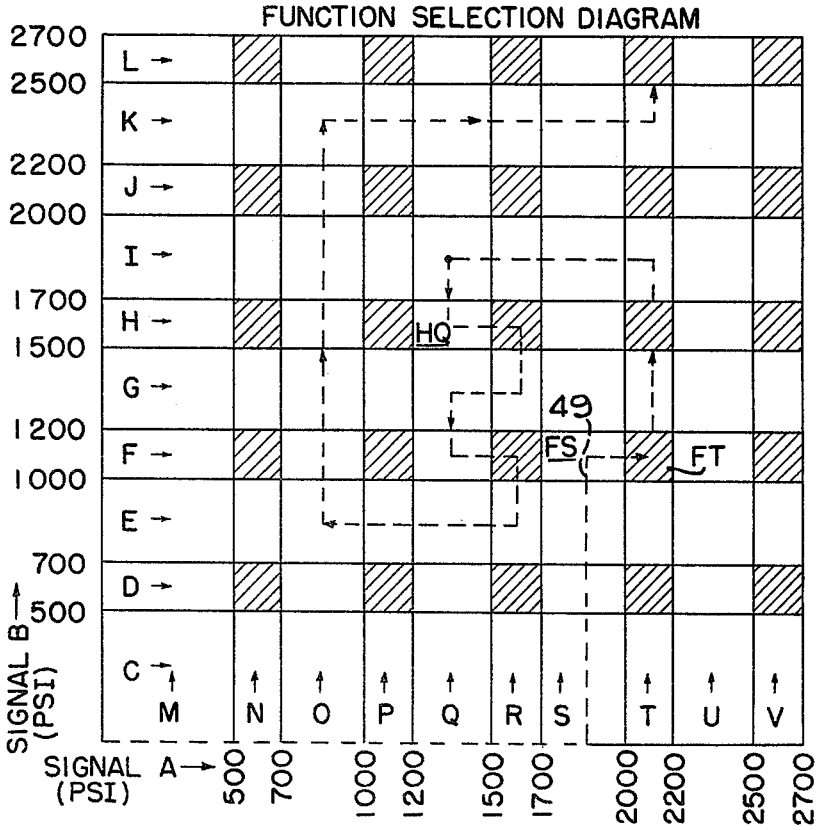
FIG_4

REG.
P
A
B
G1
R1
AL1
BL1
BL2
BL3
V1
V6
V7
V8
P6
P7
P8
PR6
PS6
PR7
PS7
PR8
PS8
PR1
PS1
PR2
PS2
P1
P2
SP1
SP2
PL1
PL2
53a
53b
53c
53d
54
55a
55b
58
59
60
63
64a
65
68
69
72a
72b
73
74
77
78
79
79a
82
82a
83
84
87
88
45
50
S
R
100
500
700
1000
1200
1500
1700

| VALVE MODE | OPERATOR CONTROLLED | | | |
|---|---|---|---|---|
| 93f | 107d | 107h | 107m | 107s |
| 93e | 107c | 107g | 107ℓ | 107q |
| 93d | 107b | 107f | 107k | 107p |
| 93c | 107a | 107e | 107j | 107n |
| | 92c | 92d | 92e | 92f |

VALVE MODE

METHOD AND APPARATUS FOR HYDRAULICALLY CONTROLLING SUBSEA EQUIPMENT

BACKGROUND OF THE INVENTION

1. Field of the Invention

This invention relates to apparatus for hydraulic control of a subsea device, and more particularly to hydraulic apparatus for the individual control of a relatively large number of subsea well devices using only a few hydraulic pressure source lines from a surface vessel to the seafloor.

2. Description of the Prior Art

The production of oil and gas from offshore wells has developed into a major endeavor of the petroleum industry. Wells are commonly drilled several hundred or even several thousand feet below the surface of the ocean, substantially beyond the depth at which divers can work efficiently. As a result, the drilling of a well, completing pipeline connections, operating of a subsea well and performing other subsea tasks must be controlled from a surface vessel or from an offshore platform. The testing, production and shutting down of the subsea well is regulated by a subsea Christmas tree which is positioned on top of the subsea wellhead. The Christmas tree includes a plurality of valves having operators which are biased to a non-active position by spring returns, and it has been found convenient to actuate these operators by hydraulic fluid which is directly controlled from the surface vessel. For this purpose, a plurality of hydraulic lines are commonly run from the surface vessel to the wellhead to open and close these valves, and to actuate other devices in the well and the wellhead during installation, testing, and operating the subsea well equipment, and also during work-over procedures being performed on the well.

A plurality of relatively short flowline loops are connected to the Christmas tree before the tree is lowered into place atop the wellhead, with the free ends of the flowline loops gathered together and supported above the seafloor to facilitate connecting them to one or more flowlines that extend to a remote collecting or storage facility. Once the Christmas tree has been installed on the wellhead, the flowline or flowline bundle is pulled across the seafloor into alignment with the flowline loops so that it and the flowline loops can be connected together in a fluid-tight manner. Hydraulic lines from the surface vessel provide power to actuate hydraulic operators which move the flowline bundle into a fluid-tight connection with the flowline loop.

In some of the prior art systems a separate hydraulic line is run from the surface vessel to each of the hydraulically powered devices at the seafloor. Some of these hydraulic lines may be run through a riser, but for many of the subsea operations the riser is too small to contain all of the lines required. A common solution is to employ additional hydraulic lines that are stored on a reel located on the surface vessel, the line being made up into a hose bundle that is connected to the outside of the drill pipe or riser and lowered therewith to the seafloor. However, such a hose bundle is expensive, and is heavy and cumbersome to handle simultaneously with the drill pipe or riser, particularly in deep water. Also a relatively large number of hydraulic lines requires a relatively large hose reel which uses a considerable amount of storage space on a work boat having a limited amount of space. By reducing the number of hydraulic lines required to control the hydraulic devices the size of the hose reel is reduced which provides a savings in weight and in the space required on the surface vessel.

Other prior art equipment uses an electrical cable that is fed off a reel located on the surface vessel as the riser or drill pipe is lowered to the well in a manner similar to the hose bundle. This cable is also expensive, heavy and cumbersome to handle when used outside the drill pipe or riser. A disadvantage of using an electrical cable inside the drill pipe or riser is that the cable must be in sections, and these sections must be connected together in an end-to-end arrangement at the junction of each section of pipe or riser. This means that a very large number of connections must be made when numerous pipe or riser sections are involved, and each of these connections must function properly in order for the system to work. It has proved to be quite a difficult problem keeping all of these electrical connections working properly in a subsea environment.

What is needed is apparatus which can be used to control a large number of subsea operators with only a few hydraulic control lines between the surface vessel and the subsea location. It is also desirable to use the same hydraulic control lines to transmit signal information from the various subsea operators to the surface vessel to also indicate the operating status of these devices. In some systems this small number of lines could be contained inside the riser. In other systems some of the hydraulic lines could be inside the riser and a few additional lines could be contained in the hose bundle. In either case, a reduction in the number of hydraulic source lines would reduce the expense and the difficulty of handling the hose bundle.

One prior art device that is used in a system for controlling a plurality of remotely positioned hydraulically actuated underwater devices by a single hydraulic control line is disclosed in U.S. Pat. No. 3,993,100, issued November 1976 to Pollard et al. The Pollard et al device involves a plurality of valves each having a pilot, and with the pilot of each valve arranged for actuation by a different pressure level in a signal manifold that is connected to all the pilots.

Another prior art apparatus for this purpose is disclosed in U.S. Pat. No. 3,952,763, issued April 1976 to Baugh. This apparatus includes a valve having a single inlet port and a plurality of outlet ports arranged so that the outlet port that is connected to the inlet port is determined by the magnitude of the pressure that is applied to said inlet port.

SUMMARY OF THE INVENTION

The present invention overcomes some of the disadvantages of the prior art by mounting a plurality of hydraulic AND-gates and other control apparatus adjacent the hydraulically-actuated subsea operators at the sea floor. Only two signal pressure lines and a hydraulic power line are connected between a surface control center and a subsea device which contains the operators. When low pressure subsea operators are used the hydraulic power line can be omitted and the operators powered by one of the signal pressure lines.

The hydraulic AND-gates, each having an output and a pair of inputs, are arranged in rows and columns. The signal pressure lines are each coupled to a source of pressurized hydraulic fluid by a corresponding pressure control means which provides the required signal pressures to the signal pressure lines. A plurality of pressure sensitive valves connected between a first one of the signal pressure lines and a first one of the inputs of each of the AND-gates provide an "enable" signal to each of the gates in a predetermined column when a predetermined value of pressure is applied to the first signal pressure line. Another plurality of pressure sensitive valves connected between a second one of the signal pressure lines and a second one of the inputs of each of the AND-gates provide another signal to each of the gates in a predetermined row when a predetermined value of pressure is applied to the second signal pressure line. By applying the proper pressures to the two signal pressure lines a predetermined AND-gate at the intersection of a predetermined row and a predetermined column is enabled and the subsea operator which is connected to the output of the enabled AND-gate is actuated.

BRIEF DESCRIPTION OF THE DRAWINGS

FIG. 3 is a diagrammatic view of a matrix showing the operators which can be controlled by using two signal pressure lines each operating at five discrete levels or positions.

FIG. 4 is a diagrammatic view of an operational matrix having rows and columns separated by inactive zones.

DESCRIPTION OF THE PREFERRED EMBODIMENT

Figure 1:
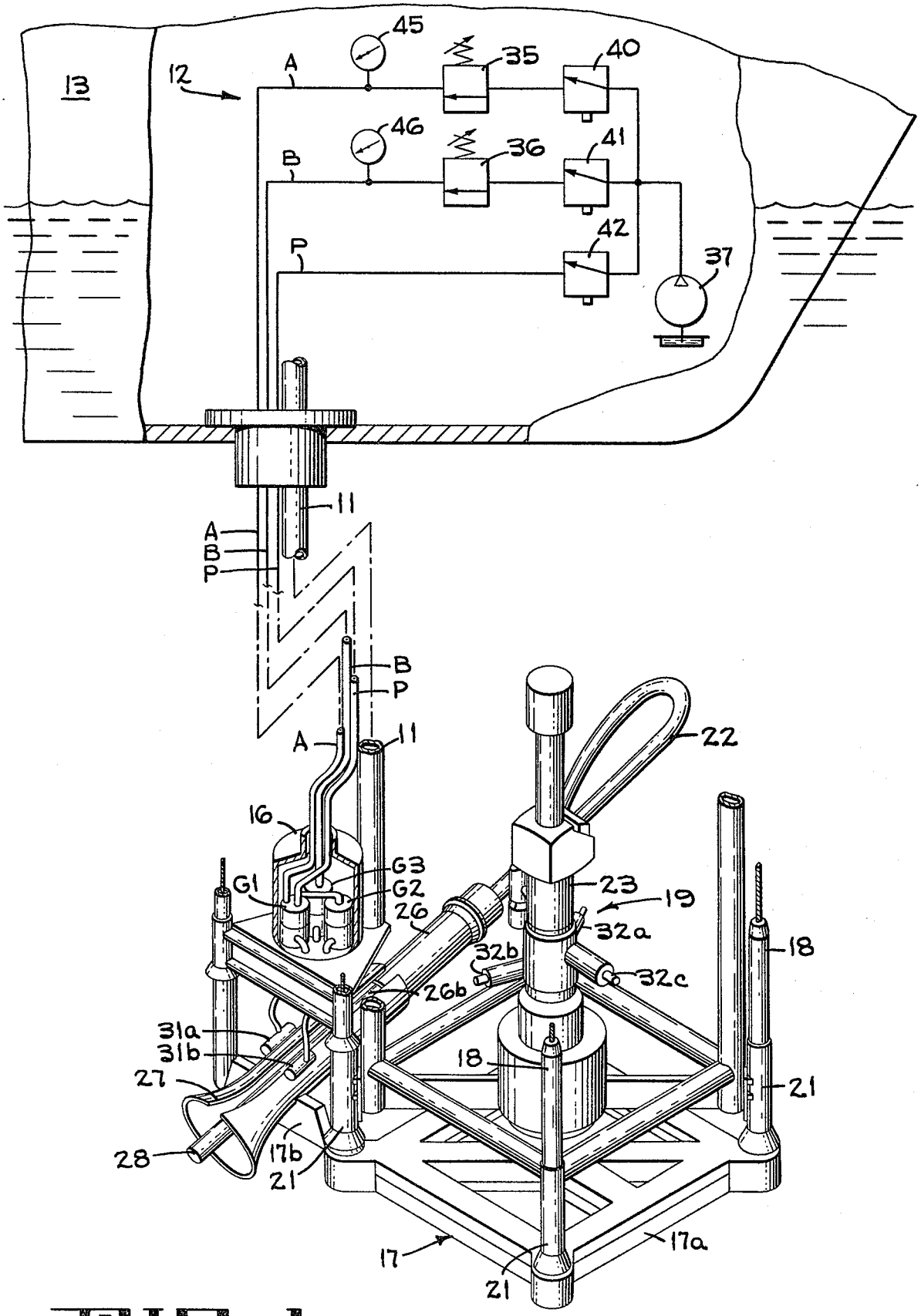
FIG. 1 is a diagrammatic view, partly in elevation and partly in perspective, with portions broken away, of a subsea wellhead system in which the apparatus of the present invention is used.
Figure 2:
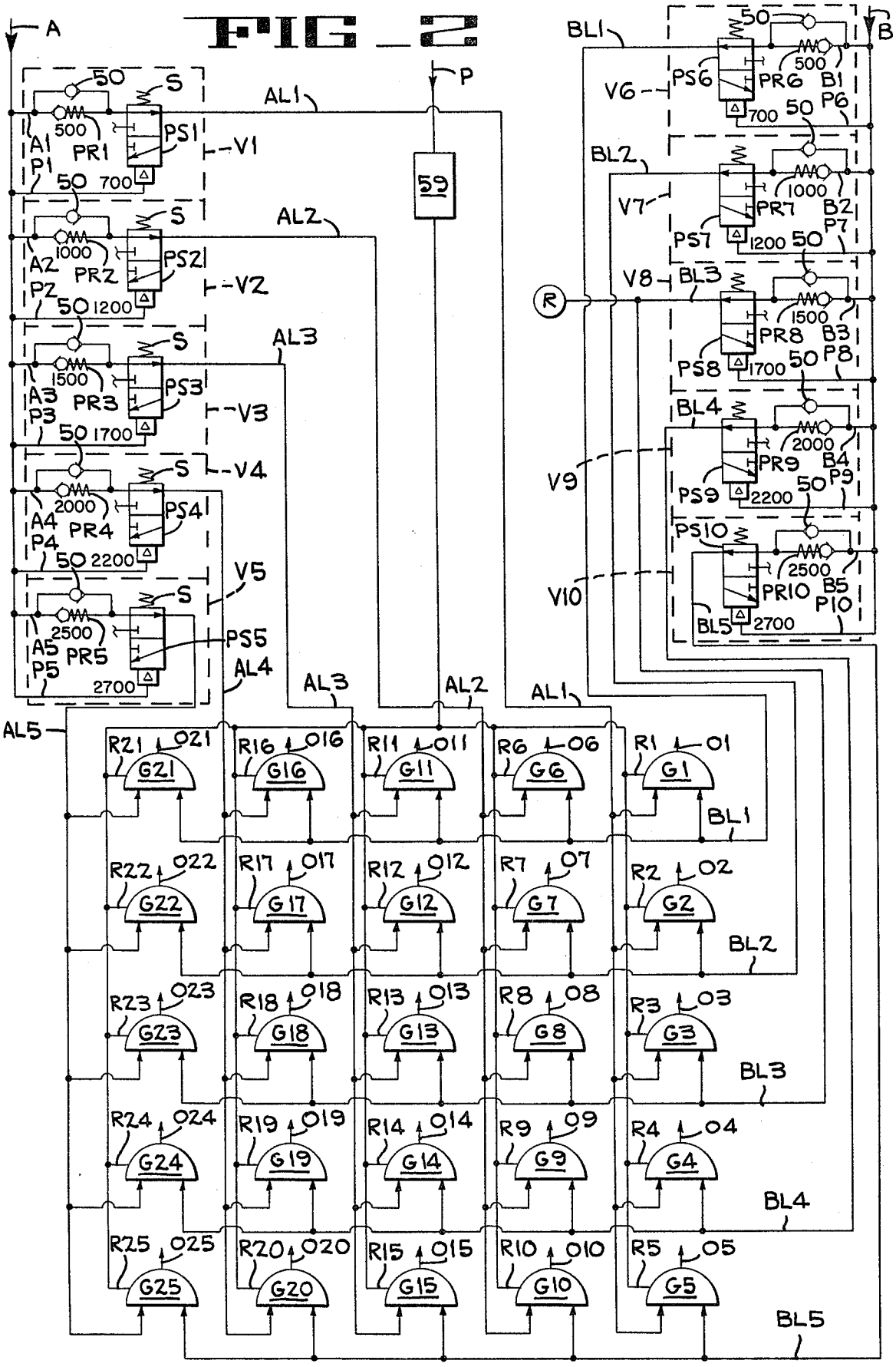
FIG. 2 is a schematic of the gate and valve circuitry of the present invention.

FIGS. 1 and 2 diagrammatically illustrate hydraulic apparatus according to the present invention for controlling many valves or other subsea well operators while using only a few hydraulic pressure source lines. As illustrated in FIG. 1, the invention can be employed with a completion/workover riser or other type of riser 11 having its upper end connected to a control center 12 on a surface vessel 13, and its lower end connected to a valve container 16 that is mounted on a subsea guidebase diagrammatically illustrated at 17. The guidebase 17 includes a main guidebase **17*a* with a plurality of guideposts 18, and an ancillary guidebase 17*b* that is welded or otherwise connected to the guidebase 17*a***.

A subsea Christmas tree assembly 19 includes a plurality of sleeves 21 which are each guided into working position on the guideposts 18 as the assembly 19 is lowered to the seafloor. A first end of a flowline 22 is connected to a Christmas tree 23, and a second end of the flowline is connected to a flowline connector 26 that is positioned at the end of an alignment funnel 27. The alignment funnel can be connected to the ancillary base **17*b* by welding or other suitable means. A flowline bundle hub 26*b*, connected on the end of a flowline 28, is guided into axial alignment with the connector 26 by the alignment funnel 27, and the hub 26*b* is secured to the connector 26 to connect the flowlines 22 and 28 together in a fluidtight manner. A pair of hydraulic rams 31*a*,31*b*, mounted on the funnel 27, provide means for locking the flowline bundle hub 26*b* in position for connection to the flowline connector 26, and power to operate the hydraulic rams is controlled by the valves in the valve container 16. These valves in container 16 also control a plurality of valves 32*a*–32*c* mounted on the Christmas tree 23** as well as other Christmas tree valves not shown.

Extending along the riser 11 between the valve container 16 (FIG. 1) and the vessel 13 are a pair of hydraulic signal lines A, B and a hydraulic power line P. The upper ends of each of the signal lines A, B are connected to a corresponding one of a pair of flow control units 35, 36, and each of the flow control units is connected to a pump 37 or other source of pressurized fluid by one of a pair of hydraulic switches 40, 41. A pair of pressure gages 45, 46 monitor the fluid pressure in the signal lines A, B, respectively. The upper end of the power line P is connected directly to the pump 37 by a hydraulic switch 42. The lower ends of the hydraulic lines A, B, P are connected to a plurality of AND-gates G1–G25 (FIG. 2) and to a plurality of valve-pairs V1–V10 mounted in the valve container 16 (FIG. 1). A plurality of outlets O1–O25 (FIG. 2) of the AND-gates G1–G25 are each connected to operators (not shown) which are used to open and close valves, connect and disconnect tree caps, control pods, etc. and provide installation, testing and operation of the well.

The schematic diagram of FIG. 2 discloses hydraulic circuitry for controlling a total of twenty-five subsea operators using only two hydraulic signal lines and one hydraulic power line between the hydraulic pump 37 (on the surface vessel) and the valve-pairs V1–V10 (located on the seafloor). If desired, a third hydraulic signal line can be added to this circuit, thereby facilitating the operation of many more AND-gates and the resulting control of many more operators.

The number of operators which can be controlled by two signal lines is diagrammatically illustrated in the matrix of FIG. 3 where a first signal controls the level or position in the columns of the matrix and a second signal controls the level or position in the rows of the matrix. The total number of functions which can be obtained and the number of operators which can be controlled is determined by the formula $N_F = N_L (N_S)$, where $N_F$ = the number of functions, $N_L$ = the number of levels of signals, and $N_S$ = the number of signal lines. While the matrix of functions shown in FIG. 3 serves to illustrate the fundamental use of two signals at a plurality of levels to control a plurality of operators, the practical use of such a matrix encounters some problems. For example, in order to reach the function 34 shown in the matrix of FIG. 3 it is necessary to pass through at least two other functions and to actuate operators which perform at these levels. This may not be desirable or practical.

A more practical solution is to provide a function selection matrix of the type shown in FIG. 4 where each of the function rows and columns of the matrix is separated from the nearest function row or column by a non-functional row or column. There is no actuation of any subsea operators in columns M, O, Q, S and U or in rows C, E, G, I and K. The only "function areas" where subsea operators are actuated are the shaded areas shown in FIG. 4. This permits movement through the non-functional rows and columns to any one of the shaded function areas without passing through any of the other function areas. For example, signal A (FIG. 4) can be increased to a value of approximately 1850 psi and held at this level while signal B is increased to a value of approximately 1100 psi to move the operation to the non-functional area FS, as shown by the dotted line 49. Increasing the signal A to 2100 psi then moves the operation to the shaded area FT and actuates the operator at the function FT without actuating any other operators during the level changing process.

Hydraulic circuitry to implement the function selection diagram of FIG. 4 comprises a plurality of hydraulic AND-gates G1–G25 (FIG. 2) each having a pair of input leads AL1–AL5, BL1–BL5, a pressure input lead R1–R25 and an output lead O1–O25, and a plurality of hydraulic valve-pairs V1–V10 each having an input lead A1–A5, B1–B5, an output lead AL1–AL5, BL1–BL5 and a pilot lead P1–P10. Each of the valve pairs (FIG. 2) includes a pressure relief valve PR1–PR10 and a pressure sensitive pilot valve PS1–PS10 connected in series to provide a hydraulic switch that is open between a predetermined lower pressure limit and a predetermined upper pressure limit. For example, the valve-pair V1 includes the relief valve PR1 which is open when the pressure at the input A1 is above 500 psi, and the pilot valve PS1 which is open when the pressure on the pilot lead P1 is below 700 psi so that fluid is coupled from the input A1 to the output AL1 when the fluid pressure on signal line A is between 500 psi and 700 psi. At all pressures below 500 psi and above 700 psi the valve-pair V1 is closed. The other valve-pairs V2–V10 are each open between the corresponding upper and lower pressure limits shown on the circuit of FIG. 2. A check valve 50 connected in parallel with each of the pressure relief valve aids in relieving pressure across the relief valve when the pilot valve opens. The outputs of the valve-pairs V1–V10 are connected to inputs of the hydraulic AND-gates G1–G25 with the outputs of the valve-pairs V1–V5 connected to one input of each of the gates which are arranged in vertical columns and the outputs of the valve-pairs V6–V10 connected to an input of each of the gates as arranged in horizontal rows.

All of the valves in FIGS. 2 and 5–7 are shown in the deenergized or relaxed position. Each of the pressure sensitive pilot valves is held in the deenergized position by a spring S until the pressure on the pilot line rises above the switching pressure. When the pilot line pressure exceeds the switching pressure the valve moves against the spring and into the energized position. For example, the pressure sensitive valve PS2 (FIG. 2) is held in the open position shown, by the spring S, until the pressure on the pilot line exceeds 1200 psi. Above 1200 psi the valve moves upward against the spring S causing the valve PS2 to close.

Figures 5, 6, 7:
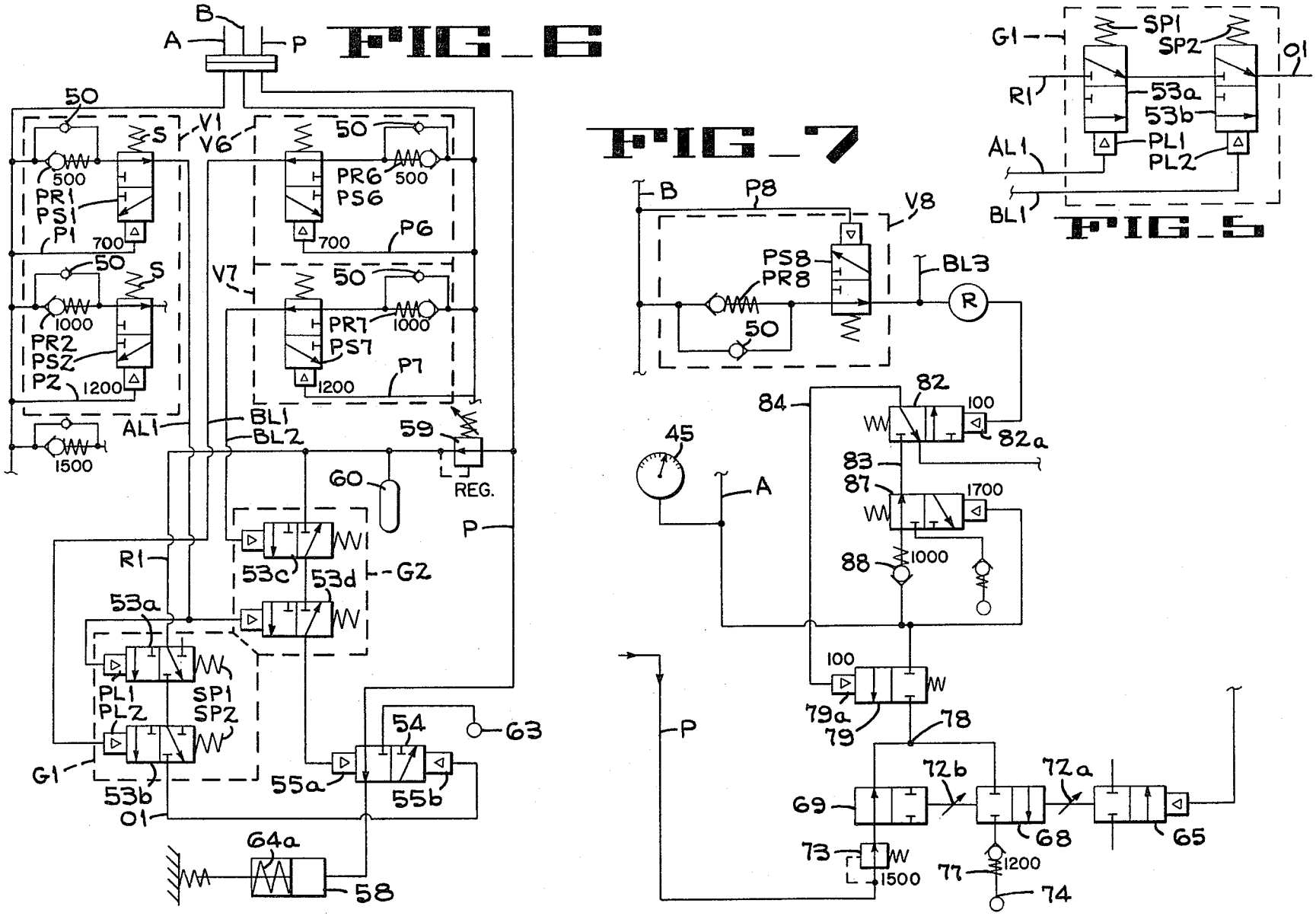
FIG. 5 comprises a schematic of the AND-gates used in FIG. 2.
FIG. 6 comprises a schematic of a portion of the circuitry of FIG. 2 showing operation of the AND-gates and showing their connections to an actuator.
FIG. 7 comprises a schematic of a circuit for sending operator status from the sea floor to a surface control unit.

Each of the AND-gates G1–G25 (FIG. 2) comprises a pair of pressure sensitive pilot valves, such as valves 53*a*, 53*b* shown in gate G1 of FIG. 5 with valves 53*a*, 53*b* connected in series between the pressure input lead R1 and the output lead O1, with the pressure input lead R1 (FIG. 5) being connected to the hydraulic power lead P (FIG. 1) and the output lead O1 being connected to a subsea operator. The AND-gate of FIG. 5 is shown with both of the pilot valves in the deenergized position. When signal pressure is applied to both of the pilots PL1, PL2 (FIG. 5) the valves each move upward against the springs SP1, SP2 to the energized position and connect the input lead R1 through the lower portion of valves 53*a*, 53*b* to the output lead O1.

Returning to the above example where the operator is associated with the shaded area of FIG. 4, the operating procedure is to increase the pressure on signal line A (FIGS. 1 and 2) by closing the switch 40 (FIG. 1) until the pressure on line A is approximately 1850 psi as read on the meter 45. This places operation of the system in column S (FIG. 4) along line 49. Closing the switch 41 (FIG. 1) and monitoring the gage 46 until the gage 46 reads approximately 1100 psi moves the operation into the intersection of column S and row F (FIG. 4). An increase of pressure on line A to 2100 psi by closing the switch 40 (FIG. 1) moves the operation into the shaded area FT, at the intersection of column T, row F (FIG. 4). At a pressure above 2000 psi on line A the pressure relief valve PR4 (FIG. 2) is open, and at a pressure below 2200 psi the pressure sensitive pilot valve PS4 is open, so that at a pressure of 2100 psi pressurized fluid is coupled from line A through the valve-pair V4 to the AL4 input of AND-gates G16–G20. The pressure of 1100 psi on signal line B causes the pressure relief valve PR7 to be open, and since the pressure sensitive pilot valve PS7 is open below 1200 psi pressurized fluid is coupled from line B through the valve-pair V7 to the BL2 input of the AND-gates G2, G7, G12, G17 and G22. The signals on inputs AL4 and BL2 enable the AND-gate G17 and connects the pressure input lead R17 through gate G17 to the output O17 where an operator (not shown) connected to the output O17 is actuated.

Details of the connection of the AND-gates and of the means for using the AND-gates to open and close subsea operators are shown in FIG. 6 where portions of the circuitry of FIGS. 2 and 5 are also shown. The circuit (FIG. 6) includes a two-position four-way pilot valve 54 which remains in one of the two positions until moved by pressure applied to the opposite pilot. When a signal pressure is applied to a pilot 55*a* the valve moves into the open position which interconnects the actuator 58 and the hydraulic power line P as shown in FIG. 6. The valve remains in the open position until a signal pressure is applied to a pilot 55*b* to close the valve by moving the valve to the left. A regulator 59 connected between the power line P and an accumulator 60 reduces the fluid pressure which is applied to the pilots of the valve 54, and the accumulator 60 prevents the pressure from dropping when a device is connected to the pressure line P through the regulator 59.

To operate the actuator 58 (FIG. 6) a fluid pressure of approximately 600 psi is applied on the signal pressure line A and a pressure of 1100 psi is applied on the signal pressure line B. The 600 psi signal from line A is coupled through the valve-pair V1 to the pilots of valves 53*a* of AND-gate G1 and 53*d* of AND-gate G2, thereby shifting the valves 53*a*, 53*d* from the closed position shown in FIG. 6 to the open position. The 1100 psi signal from line B is coupled through the valve-pair V7 to the pilot of valve 53*c* of the AND-gate G2, thereby opening the valve 53*c* and coupling fluid pressure from the accumulator 60 through the valves 53*c*, 53*d* of the AND-gate G2 to the pilot 55*a* to shift the two-position valve 54 to the open position shown. Fluid pressure from the power line P, coupled through the open valve 54, moves the actuator 58 into the energized position where it remains until a pressure signal is applied to the pilot 55*b* of the valve 54.

To deenergize the actuator 58 (FIG. 6) a signal of approximately 600 psi must be applied to signal line A and another signal of approximately 600 psi to signal line B. The 600 psi signal from line A opens the pilot valve 53*a* and the 600 psi from line B, coupled through the valve-pair V6, opens the pilot valve 53*b* to couple fluid pressure from the accumulator 60 through valves 53*a*, 53*b* to the pilot 55*b* of the valve 54. The valve 54 shifts to the left to connect the actuator 58 to a vent 63 and allow a spring 64*a* to return the actuator to the deenergized position.

In many applications it is desirable to be able to check the operation of hydraulic subsea valves to see if they have actually moved in response to signals which were supposed to have caused them to move. Apparatus for checking the position of remote valve is disclosed in FIG. 7 where signal feedback circuitry has been added to a portion of the circuit of FIG. 2. In the example shown (FIG. 7) a master valve 65 mounted in a subsea location is mechanically coupled to a pair of two-way valves 68, 69 by adjustable means 72*a*, 72*b*. The valves 68, 69 provide status position signals which are determined by the position of the master valve 65 and transmit these signals to the surface control center 12 (FIG. 1) through the signal pressure line A. Thus, status signals are transmitted from the subsea location to the control center without the use of any additional hydraulic or electrical lines to carry the return signals.

The lower line P (FIG. 7) is also connected to the two-way valve 69 by a regulator 73 which provides hydraulic fluid at a pressure of 1500 psi to the valve 69, and the two-way valve 68 is connected to a vent 74 through a 1200 psi pressure relief valve 77. The regulator 73 and pressure relief valve 77 cause a junction point 78 to have a pressure of 1500 psi when the valves 68, 69 and master valve 65 are in the position shown (the master valve open position). When the master valve is moved to the left to the closed position, the junction point 78 is connected to the vent 74 by the two-way valve 68 and the pressure relief valve 77 producing a pressure of 1200 psi at the junction point 78. A pressure signal on the pilot 79*a* of a two-way valve 79 (FIG. 7) shifts the valve 79 to the right to the open position and connects the junction point 78 to the gage 45 (FIGS. 1 and 7) where the pressure can be observed and the open or closed status of the master valve 65 can be determined.

The interrogation concerning the status of a subsea valve or operator can be done at any of the non-shaded areas on the function selection diagram of FIG. 4, such as area HQ where the signal on line B is approximately 1600 psi and the signal on line A is approximately 1350 psi. The interrogation circuit of FIG. 7 has been assigned to this area HQ.

The procedure for interrogation of the subsea circuitry to determine the status of the master valve 65 includes opening the switch 40 (FIG. 1) until the gage 45 reads approximately 1350 psi from signal line A, and adjusting the pressure on the signal line B until the gage 46 reads approximately 1600 psi, then closing switch 40 to isolate line A from the pump 37. The 1600 psi pressure in signal line B is coupled through the valve-pair V8 (FIG. 7) to the pilot 82*a* of a pilot valve 82 causing the valve 82 to move to the left and to connect a hydraulic line 83 to another hydraulic line 84. The 1350 psi pressure in signal line A does not change the open status of a pilot valve 87, which requires 1700 psi to change, so that the 1350 psi from line A is coupled through a check valve 88 and pilot valves 87, 82 to the pilot 79*a* of the valve 79 causing the valve 79 to open and connect the junction point 78 to the gage 45. With the master valve 65 in the closed position shown (FIG. 7) the 1500 psi from the valve 69 is coupled to the gage 45 (FIGS. 1 and 7) to show that the master valve is closed.

When the master valve 65 is open, the two-way valve 69 is closed and the valve 68 is open, thereby connecting the junction point 78 and the gage 45 to the pressure relief valve 77. The pressure on the signal line A decreases to 1200 psi as determined by the pressure relief valve 77. When the master valve is between the open and the closed positions, the junction point 78 is not connected to the regulator 73 and is not connected to the pressure relief valve 77 so the pressure on the signal line A remains at the approximately 1350 psi when the subsea circuitry is interrogated. The open position, the closed position and the in-between position of the master valve can all be determined by observing the pressure at the gage 45 (FIGS. 1 and 7) by using the same two signal pressure lines A, B that control operation of the various subsea operators to couple status signals from the seafloor to a control center at the surface.

Figures 8, 9:
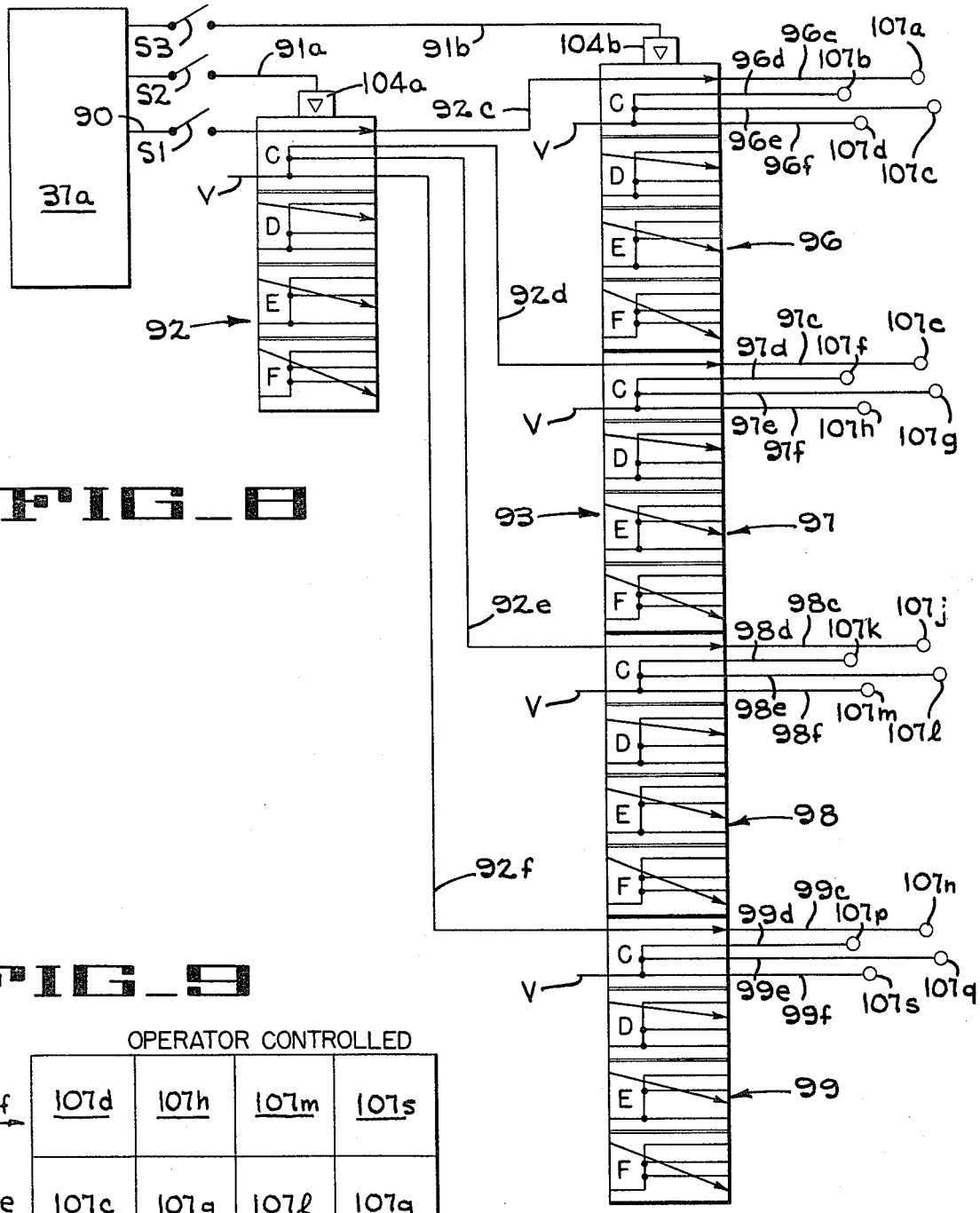
FIG. 8 comprises a schematic of another embodiment of valve circuitry of the present invention.
FIG. 9 is a diagrammatic view of a matrix showing the operators which can be controlled by the circuit of FIG. 8.

Another embodiment of the present invention diagrammatically illustrated in FIG. 8 employs a pair of multiple-position switching valves 92, 93 to replace the pressure sensitive valve-pairs V1–V10 and the AND-gates G1–G25 of FIG. 2. The operating condition of each of the valves 92, 93 is determined by the number of signal pulses applied to a pilot section rather than being determined by the valve of hydraulic pressure applied, as in the apparatus of FIG. 2. The details of construction of such a multiple-position switching valve are disclosed in a copending patent application by Lionel J. Milberger and Albert R. Tucker, now U.S. Pat. No. 4,185,541 issued Jan. 29, 1980, and assigned to the assignee of the present invention.

The inlet line of the valve 92 (FIG. 8) is connected to a hydraulic power switch S1 and the switch S1 is connected through a power line 90 to a hydraulic pump 37*a* which provides hydraulic fluid to the valve 92 when the switch S1 is closed. A pair of hydraulic switches S2, S3 each connect a pilot section 104*a*, 104*b* of one of the valves 92, 93 through a signal pressure line 91*a*, 91*b* to the hydraulic pump 37*a*. Each time one of the switches S2, S3 is closed hydraulic pressure is applied to a corresponding one of pilot sections 104*a*, 104*b* causing the associated valve to move from one operating mode or position to the next. For example, when the switch S2 is closed the valve 92 moves from mode C, as shown in FIG. 8, to mode D. When the switch S2 is opened and then closed again the valve 92 moves from mode D to mode E, then from mode E to mode F, and then from mode F back to mode C. The power switch S1 is open whenever switch S2 or switch S3 is closed.

A plurality of outlet lines 92*c*–92*f* (FIG. 8) are each connected between one of the outlet ports on the valve 92 and a corresponding one of a plurality of inlet ports on the valve 93. A plurality of outlet lines 96*c*–96*f*, 97*c*–97*f*, 98*c*–98*f* and 99*c*–99*f*, extending from the valve sections 96–99 of the valve 93, are each connected between one of the outlet ports on the valve 93 and a corresponding one of a plurality of subsea operators 107*a*–107*s*. The 4-position single-section valve 92 and the 4-position 4-section valve 93 provide individual control for a total of sixteen subsea operators (FIGS. 8 and 9) using only three hydraulic lines between the hydraulic pump 37*a* (on the surface vessel) and the valves 92, 93 (located on the seafloor). Only one subsea operator can be controlled at a time. When the valve 92 operates in mode C and valve 93 operates in mode C (FIGS. 8 and 9) the switch S1 controls the operator 107*a;* when the valve 92 operates in mode C and valve 93 operates in mode D the switch S1 controls operator 107*b;* etc. The operators which are not connected to the hydraulic power line 90 are each coupled to a vent V by the valves 92, 93.

Although the best mode contemplated for carrying out the present invention has been herein shown and described, it will be apparent that modification and variation may be made without departing from what is regarded to be the subject matter of the invention.

What is claimed is:

1. Apparatus for remote individual control of a relatively large number of hydraulically-actuated operators using a smaller number of hydraulic lines between a surface control center and a subsurface device containing said operators, said apparatus comprising:

means for connecting said apparatus to a source of hydraulic fluid pressure, a plurality of hydraulic AND-gates each having an output and a pair of inputs, each of said AND-gates providing an output pressure only when a pressure in simultaneously applied to both of said inputs, said gates being arranged in a matrix of rows and columns;

first and second signal pressure lines;

control means for coupling predetermined values of fluid pressure from said fluid source to said first and said second signal lines;

means for applying signals from said first pressure line to a first input of each of the gates in a predetermined row when the pressure in said first pressure line is within a corresponding predetermined range;

means for applying signals from said second pressure line to a second input of each of the gates in a predetermined column when the pressure in said second line is within a corresponding predetermined range; and means for coupling the output of each of said gates to a corresponding one of said operators so that only one of said operators is pressurized at a time.

2. Apparatus for remote control as defined in claim 1 wherein said control means includes a first means for regulating the value of pressure in said first pressure line and a second means for regulating the value of pressure in said second pressure line.

3. Apparatus for remote control as defined in claim 2 wherein each of said means for regulating includes a fluid-flow control unit and means for connecting said control unit between said fluid pressure source and a corresponding one of said first and said second pressure lines.

4. Apparatus for remote control as defined in claim 3 wherein said means for connecting includes a hydraulic switch connected between said fluid pressure source and said fluid-flow control unit.

5. Apparatus for remote control as defined in claim 1 wherein said means for applying signals from said first pressure line includes a plurality of series-connected valve-pairs, each of said valve-pairs having an input and an output, each of said valve-pairs having a fluid path between said input and said output when a fluid having a corresponding predetermined range of pressure is applied to said input of said valve-pair.

6. Apparatus for remote individual control as defined in claim 1 including means for coupling a status signal from said subsea operator to said first signal pressure line, said status signal indicating the open or closed position of said operator.

7. Apparatus for remote individual control of a relatively large number of hydraulically-actuated operators using a smaller number of hydraulic lines between a surface control center and a subsea device containing said operators, said apparatus comprising:

means for connecting said apparatus to a source of hydraulic fluid under pressure;

a plurality of hydraulic AND-gates each having an output and a pair of inputs, said gates being arranged in rows and columns;

a plurality of series-connected valve-pairs for conducting fluid from an input to an output when the pressure applied to a predetermined valve-pair is between a predetermined lower limit and a predetermined upper limit, said valve-pairs being segregated into first and second groups;

first and second signal pressure lines;

means for connecting said first signal line to said input of each of said valve-pairs in said first group;

means for connecting said second signal line to said input of each said valve-pairs in said second group;

means for coupling pressurized fluid from said fluid source to said first and said second signal lines;

means for coupling the output of each of said first group of valve-pairs to a first input of each of said gates in a corresponding row;

means for coupling the output of each of said second group of valve-pairs to a second input of each of said gates in a corresponding column; and means for coupling the output of each of said gates to a corresponding one of said subsea operators.

8. Apparatus for remote control as defined in claim 7 wherein said means for coupling pressurized fluid from said source includes a pair of pressure control units, means for connecting a first pressure control unit between said fluid source and said first signal input line and means for connecting a second pressure control unit between said fluid source and said second signal input line.

9. Apparatus for remote individual control as defined in claim 7 wherein each of said AND-gates includes a power input; said apparatus including a hydraulic power line; and means for connecting said hydraulic power line between said fluid source and said power input of each of said AND-gates.

10. Apparatus for remote individual control as defined in claim 7 wherein each of said valve-pairs includes first and second pressure-sensitive valves each having an input and an output, means for connecting the output of said first pressure-sensitive valve, means for opening said first valve when the pressure at the input of said first valve is above a first predetermined value, and means for closing said second valve when the pressure applied to said second valve is above a second predetermined value.

11. Apparatus for remote individual control as defined in claim 7 wherein each of said AND-gates includes means for connecting said output to said power input when pressure signals are simultaneously applied to said first and said second inputs of said gates.

12. Apparatus for remote individual control as defined in claim 7 including means for coupling a first status signal to said first signal pressure line when a subsea operator is in a first position and for coupling a second status signal to said first pressure line when said subsea operator is in a second position.

13. Apparatus for remote individual control as defined in claim 12 wherein said means for coupling status signals includes a feedback valve connected to said operator, a pair of sources of hydraulic pressure, and means for connecting said feedback valve to said pair of sources of hydraulic pressure, said feedback valve connecting a first hydraulic pressure source to said first signal pressure line when said subsea operator is in a first position and said feedback valve connecting a second hydraulic pressure source to said first signal pressure line when said subsea operator is in a second position.

14. Apparatus for remote individual control as defined in claim 13 including means for isolating said first signal pressure line from said source of hydraulic fluid when said status signals are coupled to said first signal pressure line.

15. Apparatus for remote individual control of a relatively large number of hydraulically-actuated operators using a supply line and a pair of hydraulic signal lines between a surface control center and a subsurface device containing said operators, said apparatus comprising:

means for connecting said apparatus to a source of hydraulic fluid pressure;

a plurality of hydraulic AND-gates each having an output, a pressure input lead and a pair of enabling inputs, said enabling inputs operating said gate in response to signals on said enabling inputs, each of said AND-gates providing an output pressure only when a pressure is simultaneously applied to both of said enabling inputs, said gates being arranged in a matrix of rows and columns;

first and second signal pressure lines;

control means for coupling predetermined values of fluid pressure from said fluid source to said first and said second signal lines;

means for applying signals from said first pressure line to a first enabling input of each of the gates in a predetermined row when the pressure in said first pressure line is within a corresponding predetermined range;

means for applying signals from said second pressure line to a second enabling input of each of the gates in a predetermined column when the pressure in said second line is within a corresponding predetermined range; and means for coupling the output of each of said gates to a corresponding one of said operators, said plurality of AND-gates providing an output pressure to a maximum of one operator at any time in response to said signals from said first and said second pressure lines.

* * * * *